United States Patent [19]

Worrall

[11] 4,124,211

[45] Nov. 7, 1978

[54] CIRCUIT FOR USE IN ELECTRONIC GAME OF NIM

[76] Inventor: Roy R. Worrall, 50809 Heather La., Elkhart, Ind. 46514

[21] Appl. No.: 827,984

[22] Filed: Aug. 26, 1977

[51] Int. Cl.[2] ..... A63F 3/00

[52] U.S. Cl. ..... 273/237; 315/208

[58] Field of Search ..... 273/1 F, 85 G, 237, 273/DIG. 28, 138 A, 266; 307/247 A, 116; 315/135, 136, 208, 361; 340/323 R, 248 R, 248 P

[56] References Cited

U.S. PATENT DOCUMENTS

| | | | |
|---|---|---|---|
| 2,215,544 | 9/1940 | Condon et al. | 273/237 |
| 3,240,989 | 3/1966 | Grunwaldt | 315/136 X |
| 3,500,370 | 3/1970 | Rasiel et al. | 340/248 R |
| 3,584,257 | 6/1971 | Adams | 315/208 X |
| 3,643,247 | 2/1972 | Ratcliffe | 315/135 X |
| 3,709,499 | 1/1973 | Lukens | 273/138 A |
| 3,895,807 | 7/1975 | Friedman | 273/138 A |

FOREIGN PATENT DOCUMENTS

| | | | |
|---|---|---|---|
| 1,237,010 | 6/1971 | United Kingdom | 273/237 |

OTHER PUBLICATIONS

*Electronics;* "Digital Computer Plays Nim", Nov. 1952; pp. 155–157.

*Popular Electronics;* "Win at Nim With Debicon", Jan. 1958; pp. 37–41.

*Primary Examiner*—Vance Y. Hum

*Attorney, Agent, or Firm*—Daniel Jay Tick

[57] ABSTRACT

An AND gate has a first input biased ON and a second input normally biased OFF. A switch selectively biases the second input ON. The output of the AND gate is fed back to the second input to bias the second input ON when the output is ON. A transistor connected in a common collector configuration has its base electrode connected to the output of the gate. A light-emitting diode is connected in the emitter circuit of the transistor.

5 Claims, 3 Drawing Figures

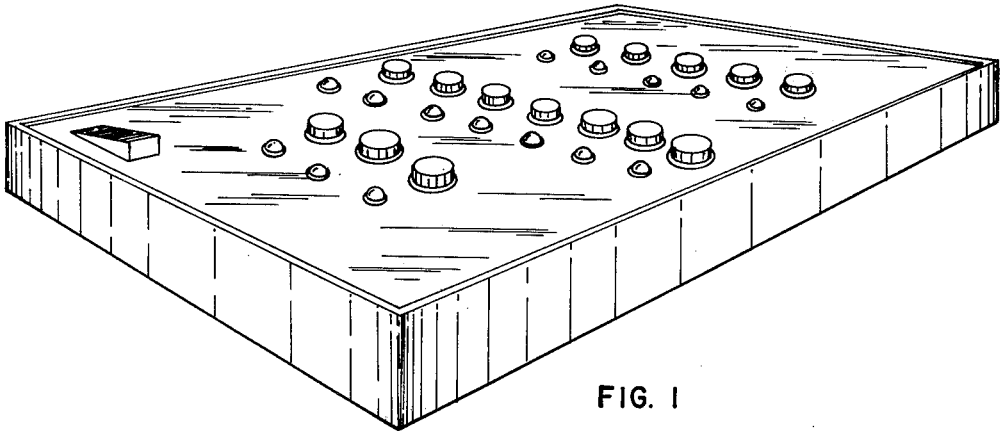
FIG. 1
FIG. 2
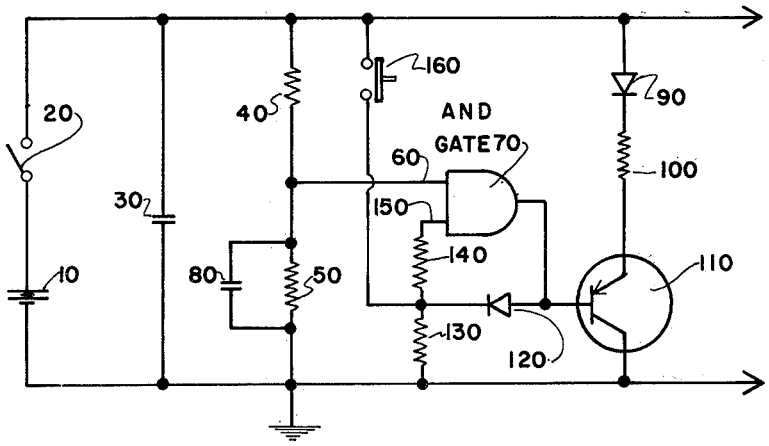
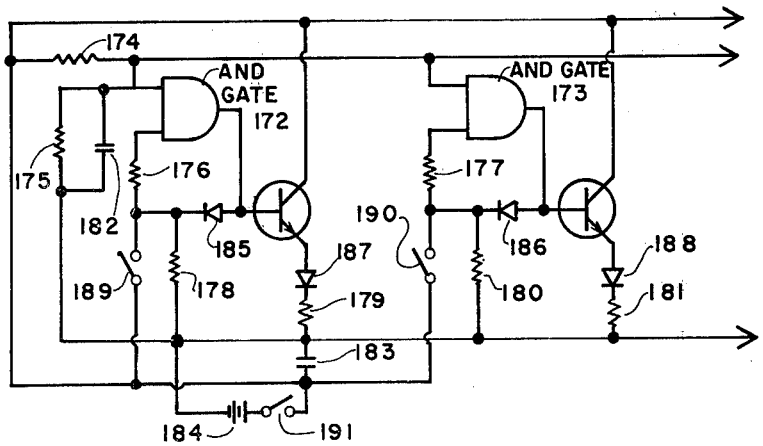
FIG. 3

CIRCUIT FOR USE IN ELECTRONIC GAME OF NIM

BACKGROUND OF THE INVENTION

In the two-person game of nim, a series of rows of sticks are established. While the game has rules not here relevant, the object of the game is to force the opponent to pick up the last stick. An electrical analog of the game can utilize rows of lights, with a switch connected to each light, and with the object of the game being to force the opponent to extinguish the last light.

This invention concerns an electrical circuit which can be used to accomplish the above objective, while providing a safeguard against one of the players surreptitiously turning one of the lights on again after extinguishing it.

BRIEF DESCRIPTION OF THE DRAWINGS

In order that the invention may be readily carried into effect, it wll now be described with reference to the accompanying drawings, wherein:

FIG. 1 is a view of an electronic game of nim, utilizing the circuit of the invention;

FIG. 2 is a circuit diagram of a first embodiment of the invention; and

FIG. 3 is a circuit diagram of a second embodiment of the invention.

DETAILED DESCRIPTION OF THE INVENTION

In the embodiment of FIG. 2, a battery 10 is connected in series circuit arrangement with a switch 20. A capacitor 30 is connected in parallel with the series circuit arrangement 10, 20 to avoid damage to an AND gate 70 when the switch 20 is opened and closed. A voltage divider composed or resistors 40 and 50 is connected in parallel with the capacitor 30 to bias a first input 60 of the AND gate 70 to a value sufficiently high so that the first input is ON or conducts a current, when the switch 20 is closed. A capacitor 80 is connected in shunt with the resistor 50, also to protect the AND gate.

A forward-biased light-emitting diode or LED 90 is connected to the positive polarity terminal of the battery 10 when the switch 20 is closed. A resistor 100 is connected in series with the LED 90 and the emitter electrode of a transistor 110. The collector electrode of the transistor 110 is connected to a point at ground potential. Normally, current flows through the emitter electrode and energizes the LED 90. The base current of the transistor 110 flows as a sink current through the output of the AND gate 70 to a point at ground potential. The base electrode of the transistor 110 is connected to the output of the AND gate 70.

A resistor 140 is connected in series circuit with the second input 150 of the AND gate 70 and with the resistor 130, thus forming a series voltage divider. The base electrode of the transistor 110 is connected to a common point in the connection between the resistors 130 and 140. A push-button switch 160 is also connected to a common point in the connection between the resistors 130 and 140 and is also connected to the positive polarity terminal of the battery 10 via the switch 20. Thus, the push-button switch 160, when closed, applies the full voltage of the battery 10 to the midpoint of the voltage divider 130, 140 and thus to the second input 150 of the AND gate. The output of the AND gate 70 is fed to the base electrode of the transistor 110 and to the anode of the diode 120.

Since the current through the base of the transistor flows to ground via the output terminal of the gate 70, no voltage is normally applied to the second input 150 of the AND gate so that said second input is normally biased OFF. Thus, since the voltages at the first and second inputs of the AND gate 70 are different, the output voltage of said AND gate is sufficiently low so as to be considered negligible, and said AND gate is in its low output condition. The second input 150 of the AND gate 70 is biased OFF by the voltage divider 130, 140, which places said second input at ground potential.

However, when the normally open push-button 160 is closed, sufficient voltage is applied to both inputs of the AND gate 70 to switch it to its high ouput condition and said AND gate provides an output voltage. This causes the potential of the base electrode of the transistor 110 to increase to prevent current from flowing in the emitter electrode, and results in said transistor being switched to its non-conductive condition and the LED 90 being deenergized. Furthermore, current from the output of the AND gate 70 is fed back through the diode 120 and the resistor 130. The voltage across the resistor 130 becomes sufficiently high to bias the second input 150 of the AND gate 70 ON, thereby maintaining said AND gate in its high output condition and maintaining said transistor in its non-conductive condition.

Hence, once the switch 20 has been closed, the LED 90 remains energized, ON or illuminated until the push-button 160 is closed, at which time said LED is deenergizd or OFF. The LED 90 remains deenergized until the switch 20 is opened and then closed again.

If a plurality of the described circuits are connected in parallel, the resultant circuit is an electronic analog of the game of nim.

The LED 90 may be replaced by an incandescent lamp, if desired.

If an NPN type transistor is used instead of the the PNP type transistor 110, the LED 90 is energized when the switches 20 and 160 are closed. The circuit operation is then the reverse of that described. The embodiment of FIG. 3 utilizes NPN type transistors 170 and 171 and functions in the same manner as the embodiment of FIG. 2, except that all the lights are OFF when the game is turned on. Then, as the players push buttons, the lights go ON.

The circuit of FIG. 3 includes AND gates 172 and 173, resistors 174, 175, 176, 178, 179, 180 and 181, capacitors 182 and 183, a battery 184, diodes 185, 186, 187 and 188 and switches 189, 190, and 191.

While the invention has been described by means of a specific example and in a specific embodiment, I do not wish to be limited thereto, for obvious modifications will occur to those skilled in the art without departing from the spirit and scope of the invention.

Games of the type described in the present application are disclosed in U.S. Pat. Nos. 2,898,108; 3,149,841; 3,224,778; 3,376,041; 3,779,553 and 3,825,266.

I claim:

1. A circuit for use in an electronic game of nim, said circuit comprising a source of electrical energy;

an AND gate having a first input, a second input and an output;

first biasing means connected to the first input and including the source of electrical energy for biasing said first input at an ON level;

a player operable switch connected to the second input for biasing the second input to an ON level when the switch is closed, thereby switching the AND gate to its conductive condition;

a feedback network connected between the output and the second input for biasing the second input at an ON level when the output is biased at an ON level;

a light source; and second biasing means connected to the second input, for normally biasing said second input at an OFF level whereby said AND gate is normally in its low output condition, said second biasing means including the source of electrical energy, and switching means connected between the light source and the AND gate, said switching means energizing said light source when said AND gate is in its high output condition.

2. A circuit as claimed in claim 1, wherein the switching means includes a transistor.

3. A circuit as claimed in claim 1, wherein the feedback network includes a diode and a resistor.

4. A circuit as claimed in claim 1, wherein the light source is a light emitting diode.

5. A circuit as claimed in claim 1, wherein the light source is a lamp.

* * * * *